United States Patent [19]

Szabo

[11] Patent Number: 4,519,544

[45] Date of Patent: May 28, 1985

[54] PORTABLE LAWN AND GARDEN SPRINKLER SYSTEM

[76] Inventor: Laszlo Szabo, Payne Ave., San Jose, Calif. 95130

[21] Appl. No.: 489,726

[22] Filed: Apr. 29, 1983

[51] Int. Cl.[3] ..... B05B 15/06

[52] U.S. Cl. ..... 239/279; 239/281; 239/561; 239/562; 239/587; 138/177; 138/178

[58] Field of Search ..... 239/279, 229, 719, 561, 239/562, 204, 267, 587, 588, 280.5, 281; 138/177, 178; 285/31, 397

[56] References Cited

U.S. PATENT DOCUMENTS

| | | | |
|---|---|---|---|
| 1,084,842 | 1/1914 | Bustin | 239/281 X |
| 1,577,225 | 3/1926 | Granger | 239/279 X |
| 1,726,490 | 8/1929 | Irving et al. | 239/204 |
| 2,895,682 | 7/1959 | Tavone | 239/281 |
| 2,930,531 | 3/1960 | Kennedy, Jr. | 239/561 X |
| 4,189,099 | 2/1980 | Bruninga | 239/200 |

*Primary Examiner*—Andres Kashnikow
*Assistant Examiner*—Daniel R. Edelbrock
*Attorney, Agent, or Firm*—Paul L. Hickman

[57] ABSTRACT

A sprinkler system characterized by a tubular, substantially square base assembly, and two tubular arm assemblies pivotally coupled to the base assembly. The base assembly is provided with a female coupling receptive to the end of a garden hose such that the base assembly can be pressurized with water. The tubular arm assemblies receive water from the base assembly and are provided with a plurality of sprinkler heads for directing the water as desired by the user. Preferably, the arm assemblies telescope so that their lengths can be varied.

9 Claims, 4 Drawing Figures

PORTABLE LAWN AND GARDEN SPRINKLER SYSTEM

BACKGROUND OF THE INVENTION

1. Field of the Invention

This invention relates generally to irrigation systems and more particularly to sprinklers for lawn and gardens.

2. Description of the Prior Art

The prior art teaches many types of irrigation systems. Some prior art irrigation systems are designed for commercial applications, such as the irrigation systems taught in U.S. Pat. No. 2,741,510 of McCulloch, U.S. Pat. No. 2,860,007 of Cornelius, and U.S. Pat. No. 3,448,927 of Blair. Other prior art irrigation systems are designed for home garden use, such as the sprinkler described in U.S. Pat. No. 2,930,531 of Kennedy, Jr.

In the Kennedy, Jr. patent, a sprinkler is described including a base having a water inlet and an water outlet, an elongated, flexible, vertically oriented tube having a lower end engaged with the outlet of the base, and a nozzle assembly attached to an upper end of the flexible tube. The nozzle assembly is designed to eject uncompensated jets of water which causes the flexible tube to oscillate back and forth as the nozzle rotates.

Problems with sprinkling devices of the prior art include uneven water coverage and lack of adjustability of the sprinkling pattern. This can result in underwatered areas, over-watered areas, and a waste of water resources.

The prior art does not disclose a sprinkler which can effectively water beyond obstacles such as shrubs and hanging branches. In consequence, prior art sprinklers must be placed within their target sprinkling area, which is not always desirable or possible.

Another drawback of prior art sprinklers is that they are not well adapted to watering long, narrow areas. Furthermore, other prior art sprinklers attempt to fully saturate a given area by dispensing water as a fine mist. However, such sprinklers are inefficient under windy conditions, since small droplets are subject to drifting during even slight air movements.

SUMMARY OF THE INVENTION

An object of this invention is to provide an adjustable sprinkler which can efficiently direct water to a desired area, even if that area is long and narrow.

Another object to this invention is to provide a sprinkler which does not have to be placed within the area targeted for sprinklers, and which can reach over obstacles such as shurbs and hanging branches.

Briefly, the invention comprises a base assembly and a pair of arm assemblies coupled to the base assembly. The base assembly has an inlet for a garden hose and two pivotable outlets which supply water to the arm assemblies. The length of the arm assemblies can be varied by means of a telescoping extension tube. Sprinkler heads are provided at the ends of the arm assemblies and at mid-length portions thereof.

An advantage of this invention is that the sprinkler does not have to placed within the target watering area. For example, the base assembly could be placed on one side of a shrub, and one or both of the arm assemblies could be extended over the shrub to water a target area on the far side of the shrub.

Another advantage of this invention is that a target area can be fully saturated due to a showering of water from above. Since the dispersion of the water is due to its fall from the end of the elevated nozzles to the ground, the droplet size can remain relatively large to prevent drifting.

Yet another advantage to this invention is that the two arms can be used to water narrow, elongated target areas.

These and other objects and advantages of the present invention will become apparent upon reading of the following detailed descriptions and a study of the accompanying drawing.

DESCRIPTION OF THE PREFERRED EMBODIMENT

Figure 1:
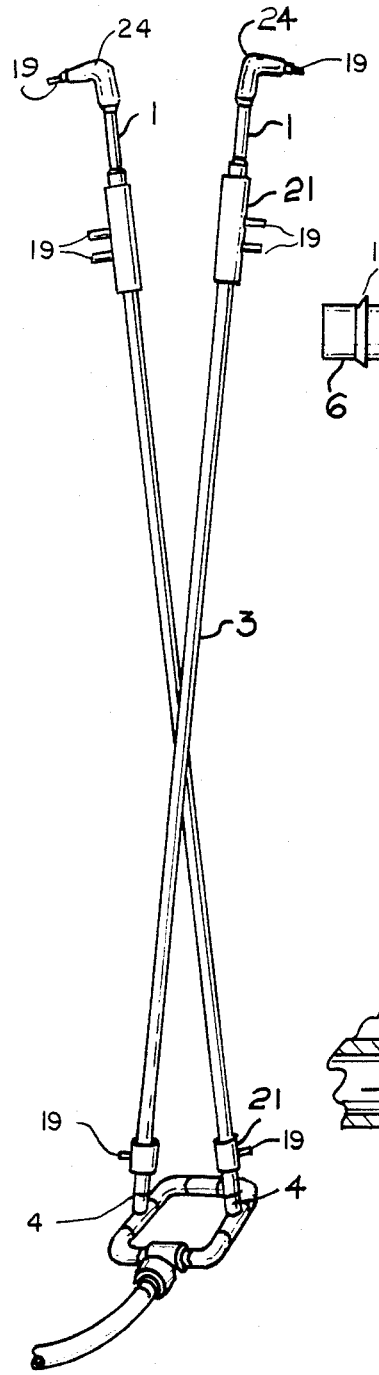
FIG. 1 is a three-dimensional drawing of the preferred embodiment.
Figure 2:
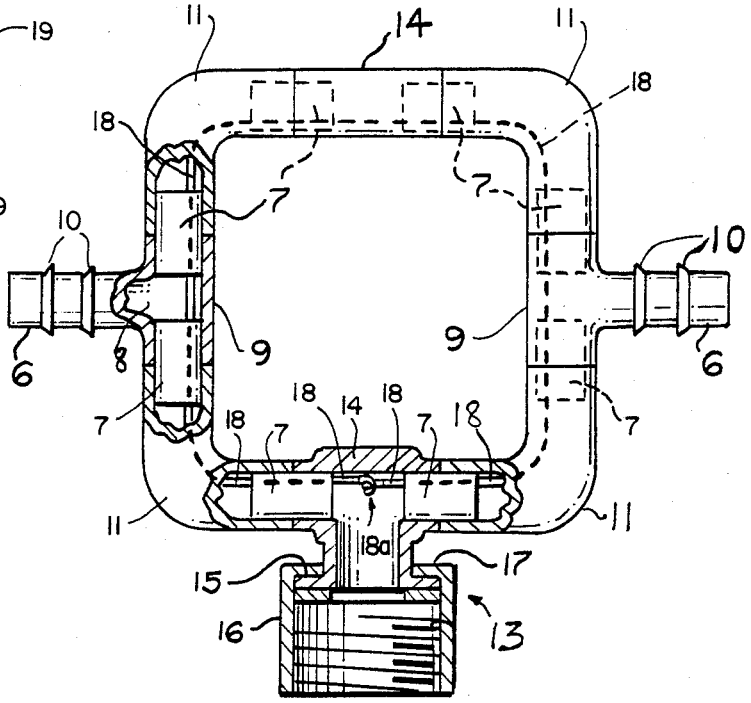
FIG. 2 is an orthographic and horizontal cross-sectional view of pivotal base in unfolded position.
Figure 3:
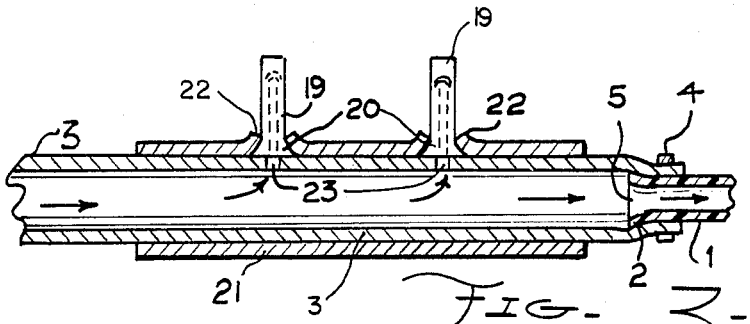
FIG. 3 is a vertical section view, showing sprinkler heads mounted on outer tube at end joints of inner and outer tubes.
Figure 4:
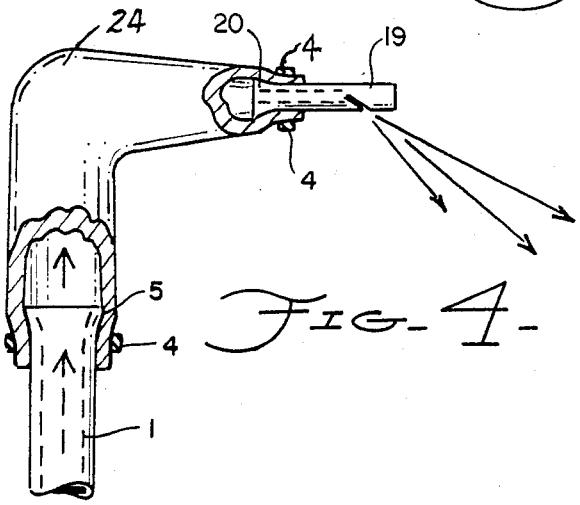
FIG. 4 is a vertical section view of sprinkler head inserted into flexible elbow.

The lawn and garden sprinkler system is comprised of two sets of two telescopically interfitted tubes concentric with each other, the inner 1 of which is preferably rigid, securing firmness and easy telescoping. Both ends of said inner tubes 1 have expanded flange portions 5 which frictionally fit within inner wall of outer tube 3. The outer tube 3 is preferably made of flexible and resilient material such as rubber or vinyl. A snap clamp 4 is forced upon the end portion of said outer tube 3, reducing its inner diameter and creating a narrow bottleneck-like shoulder portion 2 in the inner end space of said outer tube 3. When said inner tube 1 is telescoped, the flanged end 5 of said inner tube 1 is pulled by hand into contact with said shoulder portion, preventing said inner tube 1 from being pulled out of said outer tube 3 and bringing about watertight contact between the contact surfaces of said tubes 1,3. The opposite ends of said outer tubes 3 are forced onto a nipple 6, each mounted on the outside wall of a tubular body 9, equal distances from the open ends of it. Said nipple 6 is preferably molded integrally with said tubular body 9 out of plastic material and fluidly communicates with a passage opening 8 at its inner end into the interior of said tubular body 9. Said nipple 6 has a flange portion 10 at its upper end to facilitate the forcing of flexible outer tube 3 thereover. A reinforcing clamp 4 below the flange portion 10 of said nipple 6 secures said outer tube 3 in place. The open ends of the tubular bodies 9 are connected to elbow joints 11 of corresponding sizes by accurately fitting inserted flexible tube segments 7. Two sleeves 14 of corresponding sizes with said elbow joints 11, one of which is designed to accommodate a female coupling 13 connected to the remaining open ends of four elbow joints with said tube segments 7, complete a closed central base of the device in which said four elbow joints 11 function as connecting corners as well as pivotal points for said tubular bodies 9, permitting axial rotation for said tubular bodies 9, thus facilitating foldability of the device. Owing to the unique geometrical structure of central base, there is a pressure absorbent effect present in the closed system between flexible tube segments 7 and the inner wall of members of said central base, and consequently only a moderately strong mechanical holding means is required to keep the member of said central base together. An elastic piece of string 18 (rubber, plastic or the like) channeled through said central base and the ends being connected at the opening of said female coupling 13 by means of a hook 18*a* or knot functions to hold said central base together. The female coupling 13 is comprised of a body member 15 with ouwardly extending radial flange preferably integrally molded with said sleeve 14 and a coupling member 16 having a threaded interior adapted for receiving a similarly threaded male hose coupling for the delivery of water into said central base. The coupling member 16 is formed with an inward flange 17 at its inner end.

The cylindrical sprinkler heads 19 with standard half and quarter sprinkling patterns are specifically adapted for my unique way of mounting them onto outer tube section 3. With outwardly extending radial flange 20 at their base, a smooth bottom side enables their easy sliding on the outer surface of outer tube. For mounting said sprinkler heads 19 onto said outer tube 3, rigid transparent sleeves 21 (on outer tube accurately fitting) are used. Said sleeves 21 have one or two holes through the side wall according to the number of sprinkler heads to be accommodated. There is an even protrusion 22 along the circumference of said holes to the extent of accommodating the flanged base 20 of said sprinkler heads installed through the interior of said sleeves 21. Discharge holes on outer tube wall 23, corresponding in size with that of the interior of said sprinkler heads, bring about the fluid communication between said sprinkler heads and the interior of said outer tube. The expansion of said outer tube 3 upon water pressure against the base 20 of said sprinkler heads 19 and said sleeve wall 21 results in complete sealing. Shutting off sprinkler heads is individually attainable by turning said sleeves 21 axially on outer tube 3. The two end sprinkler heads 19 and inner tube end 1 are connected by rubber elbows 24 by forcing the end of said elbow 24 onto flanged end 5,20 of said inner tube end 1 and sprinkler heads 19. Reinforcing clamps 4 are used on both ends of said elbows.

The preferred embodiment of my invention features four sprinkler heads with half sprinkling pattern (one located at each end of inner tube and two at central base) and four sprinkler heads with quarter sprinkling pattern (located at both ends of outer tube).

To utilize the interacting effect of sprinkling patterns, the individual sprinkler heads are turned (by hand) toward a designated direction according to the shape of target to be sprinkled. For example, for an elongated area, the system is placed along the edge of target to be sprinkled, and all but one sprinkler head is directed toward the target. In order to avoid overcoverage, one sprinkler head at central base is turned off. The flexible outer tube allows further adjustability for the device by enabling the following of irregular lines (which often is the case).

Although I have shown and described my unique lawn and garden sprinkler system with reference to a particular preferred construction thereof, it is to be understood that this invention is not to be limited to the exact arrangement of parts shown in the accompanying drawings or described in this specification, as various changes can be made in the size, material and arrangement of the various parts without departing from the spirit and scope of my invention as defined by the following claims.

What I claim is:

1. A sprinkler comprising:

a base assembly including inlet means adapted to receive the end of a garden hose, a pair of outlet means, and primary manifold means for distributing water from said inlet means to said pair of outlet means, said pair of outlet means being pivotally attached to the remainder of said base assembly to permit independent pivotal motion; and a pair of arm assemblies associated, one each, with respective ones of said pair of outlet means, each arm assembly including a first tubular member having a lower end coupled to one of said pair of outlet means, a second tubular member having a lower end portion telescopically engaged with an upper end portion of said first tubular member, and a first sprinkler means coupled to an upper end of said second tubular member.

2. A sprinkler as recited in claim 1 wherein each of said pair of arm assemblies further includes a sleeve valve telescoped over said first tubular member proximate said first tubular member's upper end, said sleeve valve being provided with second sprinkler means which is activated by rotating said sleeve valve to align apertures provided in said sleeve valve with apertures provided in said first tubular member.

3. A sprinkler as recited in claim 2 wherein each of said pair of arm assemblies further includes a third sprinkler means provided proximate said first tubular member's lower end.

4. A sprinkler as recited in claim 3 wherein each of said pair of arm assemblies further includes clamping means for restricting the movement of said second tubular member relative to said first tubular member.

5. A sprinkler as recited in claim 4 wherein said first sprinkler means is coupled to said upper end of said second tubular member by an elbow joint.

6. A sprinkler as recited in claim 1 wherein said primary manifold means includes a first tubular manifold section coupling said inlet means to a first outlet means, and a second tubular manifold section coupling said inlet means to a second outlet means.

7. A sprinkler as recited in claim 6 further comprising secondary manifold means coupling said first outlet means directly to said second outlet means, such that a closed fluid path is created around the base assembly.

8. A sprinkler as recited in claim 7 wherein said primary manifold means and said secondary manifold means are coupled to said pair of outlet means with tubular segments engaging end portions of said pair of outlet means and said primary manifold means and said secondary manifold means, wherein said pair of outlet means may independently pivot on said tubular segments.

9. A sprinkler as recited in claim 7 further comprising an elastic member formed into a loop engaging the inner walls of said base assembly along said closed fluid path, said elastic member providing a biasing force holding said base assembly together.

* * * * *